United States Patent [19]

Trotter, Sr.

[11] Patent Number: 4,889,155

[45] Date of Patent: Dec. 26, 1989

[54] WATER COLLECTION MAT FOR DISH-WASHERS

[76] Inventor: Ansel B. Trotter, Sr., Rte. 1, Box 259, Batesburg, S.C. 29006

[21] Appl. No.: 274,014

[22] Filed: Nov. 21, 1988

[51] Int. Cl.[4] ..... F16K 23/00

[52] U.S. Cl. ..... 137/312; 137/362; 4/252 A

[58] Field of Search ..... 137/312, 362, 313; 4/252 A, 613, 614; 134/57 D; 68/207

[56] References Cited

U.S. PATENT DOCUMENTS

| | | | |
|---|---|---|---|
| 1,034,340 | 7/1912 | Bishop | 137/362 |
| 1,507,628 | 9/1924 | Schuyler | 137/312 |
| 1,825,033 | 9/1931 | Walker | 137/312 |
| 3,069,671 | 12/1962 | Taylor | 137/312 |
| 3,329,231 | 7/1967 | Takenouchi | 137/312 |
| 4,418,712 | 12/1983 | Braley | 137/312 |
| 4,679,590 | 7/1987 | Hergenroeder | 137/312 |
| 4,765,360 | 8/1988 | Baird | 137/312 |
| 4,775,067 | 10/1988 | Mount | 137/312 |

*Primary Examiner*—A. Michael Chambers

[57] ABSTRACT

This mat is designed to be placed beneath a dish-washer to catch any water leakage to prevent rot in a house. Primarily, it consists of a flexible base with an attached flexible arm that can be bent downwards to easily push a dish-washer onto the top portion of the mat. The top surface of the base is also inclined towards the center of the mat, so as to form a sump for the water to drain to the center and into an opening in which is secured a flexible tube that extends through the house floor.

7 Claims, 1 Drawing Sheet

WATER COLLECTION MAT FOR DISH-WASHERS

BACKGROUND AND FIELD OF THE INVENTION

This invention relates to drain devices, and more particularly, to a water collection mat for dish-washers.

DESCRIPTION OF PRIOR ART

References found are Brown 3,770,002, Collins 3,473,553, Hubert 3,304,950, and Martin et al 3,186,427.

While these devices may be suitable for the particular purpose to which they address, they will not be as suitable for the purpose of the instant invention, as hereinafter will be described.

The principal object of this invention is to provide a water collection mat for dish-washers that will be of such design, as to prevent an over-flow or leak from a dish-washer from causing floor rot that can cost a great deal of money to be repaired.

Another object of this invention is to provide a water collection mat for dish-washers that will be of such design, as to collect the over-flow or leaking water and direct its flow under the house in which the dish-washer is.

Other objects of the invention are to provide a water collection mat for dish-washers that will be simple in design, easy to install and inexpensive to manufacture.

SUMMARY OF THE INVENTION

A water collection mat for dish-washers comprises a rimmed and flexible body forming an inner sump portion for water drainage into an attached tube that extends through the floor of a house, so as to direct the over-flow or leaking water under the house.

DETAILED DESCRIPTION

Figure 1:
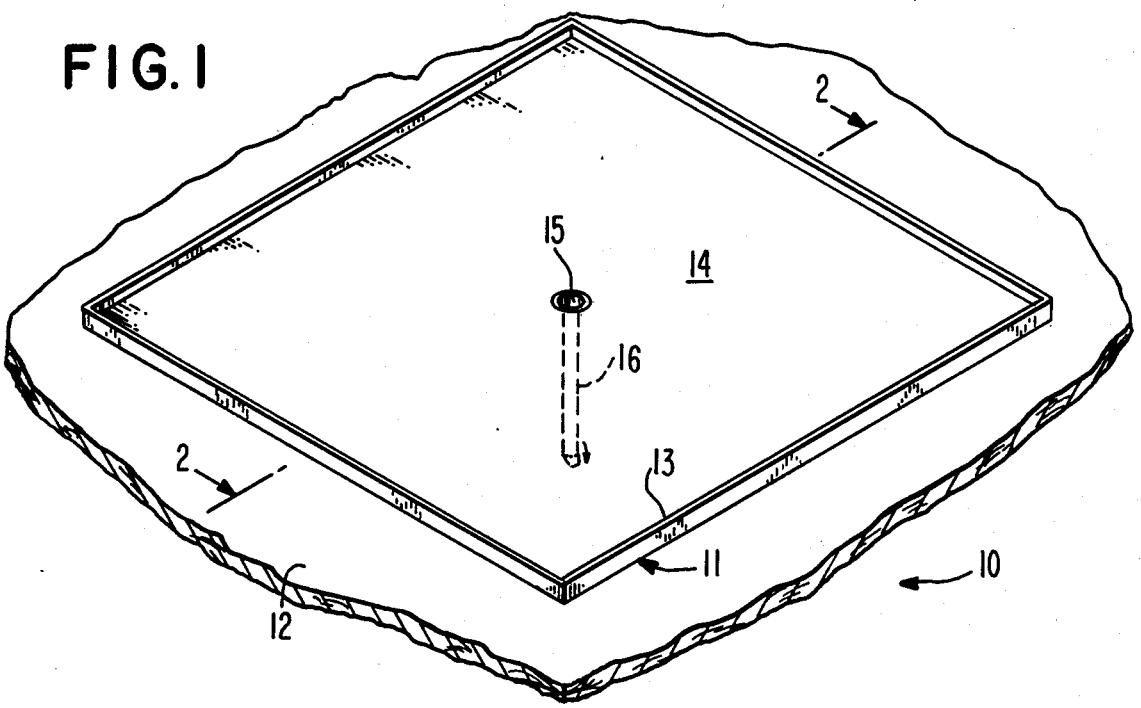
FIG. 1 is a perspective view of the instant invention.
Figure 2:
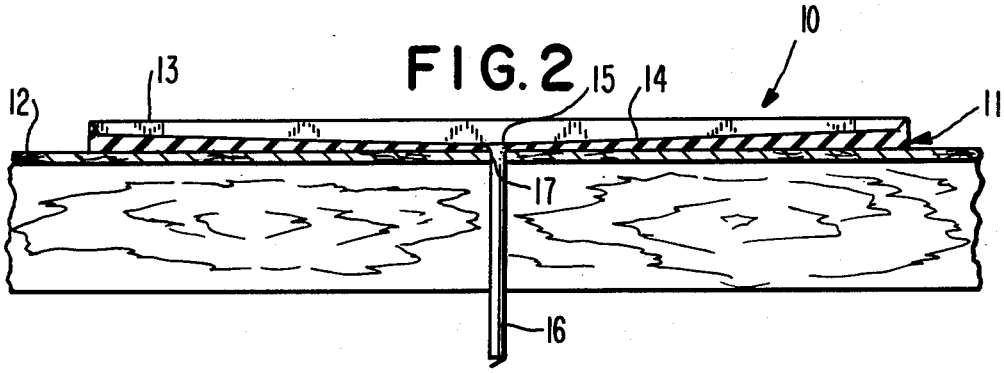
FIG. 2 is a cross-sectional view taken along the line 2—2 of FIG. 1.

Accordingly, a mat 10 is shown to include a base 11 fabricated of flexible rubber or plastic that is placed on floor 12. A rim 13 is provided and is integrally attached to base 11 for over-flow spilling or splashing of water prevention, and the inner surface 14 is inclined towards the center of the base 11, so as to form a sump for water drainage to a center opening 15.

A flexible tube 16 is provided and is fixedly secured in opening 15 in a suitable manner (not shown), and tube 16 extends through an opening 17 drilled through floor

12, for directing the drainage water beneath the house to prevent floor rot.

Figure 3:
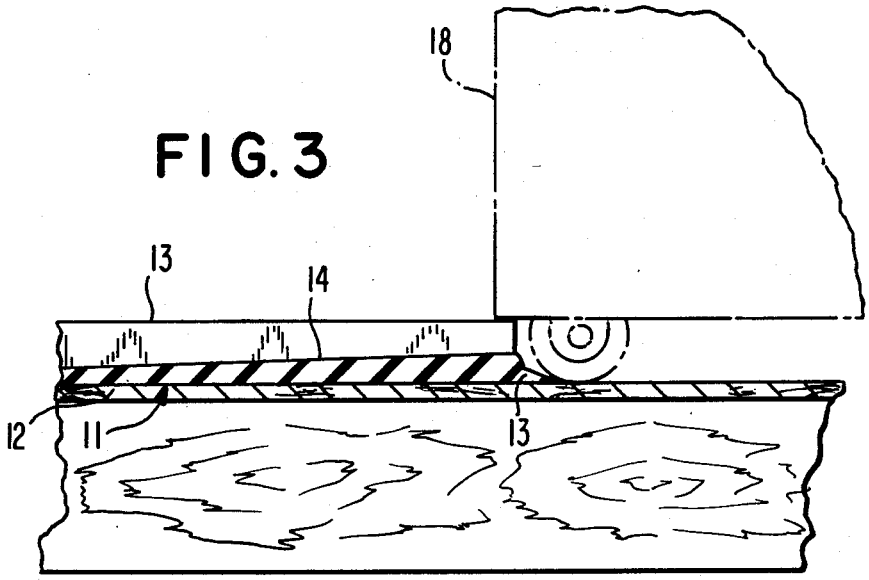
FIG. 3 is a fragmentary and enlarged cross-sectional view similar to FIG. 2, but shows the rim bent down to position the dish-washer.

In installation, mat 10 is placed in the desired position on floor 12 and with a pencil, a circle is marked on the floor 12. The mat 10 is then removed and the hole 17 is drilled through the marked circle. After the above, mat 10 is again positioned with its opening 15 in alignment with 17 through floor 12. One end of the tube 16 is glued in the opening 15 of base 11, and the dish-washer 18 as shown in FIG. 3, is placed on the mat 10 by bending down the flexible rim 13.

In use, the over-flow or leaking water from the dish-washer 18, flows into the sump portion of the base 11 and passes out the tube 16 beneath the house.

While various changes may be made in the detailed construction, such changes will be within the spirit and scope of the present invention, as defined by the appended claims.

What is claimed is:

1. A device for use with a dishwasher and the like comprising:

a base dimensioned for underlaying said dishwasher, said base having an inner surface and an opening through said base;

a rim integral with said base wherein said rim is tapered so that when bent downwardly, said rim provides a ramp for moving said dishwasher thereon;

a tube vertically disposed in said base and secured to said base at said opening, said inner surface inclined toward said opening so that liquids are directed from said inner surface through said tube.

2. The device of claim 1 wherein said opening is in the center of said base.

3. The device of claim 1 wherein said device is made of rubber or plastic.

4. The device of claim 2 wherein said device is made of rubber or plastic.

5. An apparatus comprising in combination:

means for washing dishes, and the like, in liquids;

a base dimensioned for underlaying said washing means, said washing means positioned over said base, said base having an inner surface and an opening, said inner surface inclined toward said opening;

a flexible rim integral with said base, said rim tapered so that said washing means can be positioned over said base by bending said rim downwardly and outwardly and moving said washing means onto said rim; and a tube secured to said opening, said tube directing liquids from said inner surface.

6. The apparatus of claim 5 wherein said opening is in the center of said base.

7. The apparatus of claim 5 wherein said base and said rim are made of plastic or rubber.

* * * * *